United States Patent [19]

Rossi et al.

[11] Patent Number: 4,510,480

[45] Date of Patent: Apr. 9, 1985

[54] THERMOSTAT WITH TEMPERATURE PULL-DOWN FACILITY

[75] Inventors: Guglielmo Rossi, D-Stutensee-Freidrichstal; Mario Gemma, Linkenheim-Hochstetten, both of Fed. Rep. of Germany

[73] Assignee: Ranco Incorporated, Dublin, Ohio

[21] Appl. No.: 465,859

[22] PCT Filed: Jun. 9, 1982

[86] PCT No.: PCT/GB82/00171

§ 371 Date: Feb. 7, 1983

§ 102(e) Date: Feb. 7, 1983

[87] PCT Pub. No.: WO82/04497

PCT Pub. Date: Dec. 23, 1982

[30] Foreign Application Priority Data

Jun. 9, 1981 [GB] United Kingdom ..... 8117560

[51] Int. Cl.[3] ..... H01H 37/38

[52] U.S. Cl. ..... 337/321; 200/83 S; 337/117

[58] Field of Search ..... 337/321, 312, 318, 319, 337/320, 309, 311, 306, 119, 118, 117, 115; 200/83 S, 83 W

[56] References Cited

U.S. PATENT DOCUMENTS 2,114,740 4/1938 Henning ..... 337/117

FOREIGN PATENT DOCUMENTS 454054 9/1936 United Kingdom .

*Primary Examiner*—Harold Broome

*Attorney, Agent, or Firm*—Watts, Hoffmann, Fisher & Heinke

[57] ABSTRACT

A thermostatic switch unit for controlling a freezer or, for example, refrigeration apparatus in automotive air conditioning, includes a switch (1) which is acted upon by a thermostat mechanism responsive to the working temperature of the evaporator so as to maintain this temperature within a normal working range which is presettable by means of a control knob (18) in a conventional manner. By depressing manually a push button (26) mounted centrally in the control knob a spring loaded trip lever (29) is rotated to release a spring loaded lever (35) into engagement with a switch operating plunger (2, 3), closing the associated switch contacts (21) and causing the compressor motor of the apparatus to run until a low temperature, below the preset working range of the equipment, is reached, when the latch mechanism (29, 35) is reset automatically by the temperature sensing bellows (8) acting through the operating lever (4) of the thermostat mechanism. Such a semi-automatic temperature pull-down cycle can be selected by the push button (26) irrespective of the setting of the working temperature control knob (18).

14 Claims, 5 Drawing Figures

THERMOSTAT WITH TEMPERATURE PULL-DOWN FACILITY

This invention relates to a thermostatic switch unit for controlling the operation of refrigeration apparatus. The invention is applicable to refrigeration plant generally, including freezer equipment and refrigeration systems used in vehicle air conditioning.

Freezers are normally preset to preserve food at a sub-zero freezing temperature, typically −20° C. When loading fresh food or freshly prepared or purchased food into a freezer the newly introduced food is generally at ambient temperature. It is important that the food be cooled rapidly to avoid damage to the individual cells through the formation of large ice crystals. More particularly, cooling from 0° C. to −5° C., the temperature range in which the consolidation of ice crystals occurs, should be carried out as fast as possible, ideally in less than 30 minutes. A slower transition in temperature would permit the formation of large ice crystals which could in turn cause rupture of individual food cells, spoiling the texture and quality of the food.

With a view to effecting rapid freezing of newly introduced food some freezers have the facility for continuous running of the associated compressor in order to exploit the full cooling capacity of the equipment. Such continuous running for rapid cooling is usually achieved by the provision of an override switch in parallel with the normal thermostatic control switch of the compressor motor. The override switch would be a double pole switch which, upon closure, also illuminates a monitoring lamp to indicate that the thermostatic switch has been by-passed and that the compressor is running continuously. Alternatively, the thermostatic control switch may have a temperature setting control shaft which is movable into a position in which it effects direct mechanical operation of the thermostatic switch, effectively by-passing thermostatic control and ensuring continuous running of the compressor motor. With both of these arrangements the overriding or by-passing of the thermostatic control, and therefore the continuous running of the compressor motor, can be cancelled only by manual resetting of the control switch. If the user forgets to reset the switch, or omits to note the time of operation of the override or by-pass switch, the continuous running of the compressor may be terminated at the wrong time: if the override switch is reset prematurely the freezing of the food will be incorrect, while if the user forgets to reset the override switch, or rests it too late, the freezer will attain too low a temperature, and energy will be wasted.

The period of time for which a compressor of a freezer has to operate to effect a desired degree of fast cooling is dependent upon the mass of food to be frozen and the mass of existing frozen food in the freezer. The correct time for effective rapid freezing may, for example, vary from one to thirty hours, making it difficult or impossible for the user to evaluate the required freezing time correctly.

One of the objects of the present invention is to provide a thermostatic control capable of controlling a freezer to effect rapid freezing of newly introduced goods, with automatic resetting of the thermostatic control when a preset temperature has been reached in the fast-freeze condition.

According to the present invention there is provided a thermostatic switch unit for controlling the operation of a refrigeration or freezer apparatus comprising a switch acted upon by a thermostat mechanism associated with a single temperature sensing element responsive to the working temperature of the apparatus, the said mechanism including a switch operating lever and a spring of adjustable force acting on the lever to predetermine upper and lower limits of a normal working range, of the unit, and manually operable means which when operated act upon the switch, or upon the thermostat mechanism, to cause closure of the switch, characterized in that the manually operable means include a latch mechanism which normally retains a pre-load element in an inoperative position and which is tripped by operation of the manually operable means to bring the pre-loaded element into an operative position in which it loads part of the thermostat mechanism in opposition to the spring so that following closure of the switch the switch re-opens, and the latch mechanism is reset automatically to return the pre-loaded element to its operative position only when the sensing element senses a predetermined pull down temperature lower than the said lower limit of the normal working range of temperatures in the apparatus.

The thermostatic switch unit of the present invention, in contrast to previous systems of the kind referred to above, does not override or by-pass the thermostat mechanism when operated to select continuous operation of the apparatus, but rather acts upon the thermostat mechanism itself with the effect of lowering, for one complete switching cycle, the lower temperature is reached quickly by continuous operation of the apparatus, the switch unit being reset automatically when the predetermined low temperature is reached. Once reset, the thermostat mechanism operates normally.

The invention is not applicable solely to freezer equipments, but is in general applicable to any situation where there is a need to effect a rapid pull-down in the working temperature of a refrigeration apparatus by altering the normal cycling of a thermostatic control. For example, another important practical application of the invention is in the control of refrigeration apparatus associated with automotive air conditioning equipment. With a view to achieving the ideal internal temperature and comfort level rapidly there is a clear requirement for the continuous operation of the refrigeration compressor upon first operating the equipment under hot ambient conditions, particularly when entering a car which has been standing in the sun. By using a thermostatic switch unit according to the invention the evaporator unit of the vehicle air conditioning equipment can be brought to a predetermined low temperature, lower than the normal working range, by manual selection of an initial temperature "pull down" operation followed by automatic resetting of the unit to its normal operating condition. Any ice which accumulates on the evaporator unit during the initial "pull down" in temperature will rapidly disperse upon the subsequent reversion of the control to its normal operating mode.

The thermostat mechanism may be of any suitable type. In a preferred embodiment of the invention the thermostat mechanism has a vapour-filled bellows or like element connected to a sensor which is responsive to the working temperature of the apparatus and which operates the associated switch. The vapour filling of the bellows is preferably such that the internal pressure in the bellows is greater than atmospheric pressure over the normal range of working temperatures but is less than atmospheric upon the achievement of the predetermined low temperature at which a temperature "pull down" operation is terminated. In the event of a failure of the vapour-filled bellows or the sensor connected to it, the internal pressure in the bellows will drop to the ambient pressure, and will not achieve the sub-atmospheric pressure at which the temperature "pull-down" terminates. Upon manual initiation, of the temperature "pull-down" operation, therefore the refrigeration apparatus will run continuously. This is a useful fail-safe characteristic in a freezer, since it ensures that the freezer operates continuously until the fault in the thermostat mechanism can be rectified. Such a fail-safe characteristic would not, however, be embodied in a thermostatic control switch according to the invention used in conjunction with automotive air conditioning equipment, to avoid excessive formation of ice on the evaporator, which could cause permanent damage to the equipment.

The latch mechanism preferably comprises a trip lever which has a reset position in which it engages the pre-loaded element and maintains it in its inoperative position and a tripped position in which it releases the pre-loaded element into its operative position, the trip lever being resiliently loaded into its reset position.

In one embodiment of the invention the pre-loaded element of the latch mechanism, when in its operative position, acts upon a plunger which is carried by the thermostat mechanism, the said plunger acting directly upon the switch to effect closure of the latter upon tripping of the latch mechanism.

The trip lever may have a cam surface which is engaged by the preloaded element when the latter is in its inoperative position, such that, when the sensed temperature reaches the said predetermined value after tripping of the latch mechanism, the preloaded element is displaced by the thermostat mechanism to a position in which it re-engages the said cam surface and is retained in engagement therewith by the resilient loading of the trip lever. The trip lever may be arranged so that it is displaced into its reset position under its resilient loading when the preloaded element re-engages the cam surface, and causes, through the cam surface, a displacement of the preloaded element to maintain it in its inoperative position. The cam action between the trip lever and the preloaded element thus causes automatic resetting of the trip lever when the said predetermined low value of the sensed temperature is reached at the end of a temperature "pull-down" cycle for fast freezing.

The trip lever may be movable into its tripped position by manual operation of a push button. The push button may be movable axially in a bore of a shaft on which a setting cam for the thermostat mechanism is mounted. In an alternative embodiment the operation of the trip mechanism is effected by a cam surface or protuberance provided on a cam which is effective to vary the working temperature setting of the thermostat mechanism or on a shaft on which said cam is mounted.

In a preferred embodiment of the invention the predetermined "pull-down" temperature at which the switch is re-opened is substantially independent of the working temperature setting of the thermostat mechanism. Alternatively, the said "pull-down" temperature may be variable upon variation of the working temperature setting of the thermostat mechanism.

Thus in the above-mentioned preferred embodiment the preloaded element comprises a lever which is acted upon by a spring the biassing force of which is adjustable by a cam which also presets the normal working temperature range of the thermostat mechanism, so that the said predetermined pull-down temperature at which the switch is re-opened is substantially independent of the cam setting.

The thermostat mechanism associated with the switch may be arranged as described in U.K. Patent specification No. 1558474. The thermostat mechanism may have the additional feature whereby an overtravel displacement of the associated switch in response to a sensed temperature above the normal operating range of temperatures of the apparatus, causes closure of associated auxiliary switch contacts which may operate an audible and/or visual warning device, indicating malfunction of the apparatus, irrespective of whether or not a temperature pull-down operation is in progress. The unit may further include a warning lamp or other warning device which is energised, to provide an indication of a temperature "pull-down" cycle, each time the manually operable means are operated.

Signal means may be provided to afford a visual temporary indication upon each operation of the manually operable means to initiate a temperature "pull-down" cycle.

The invention will be further described, by way of example, with reference to the accompanying drawings, in which.

Figure 1:
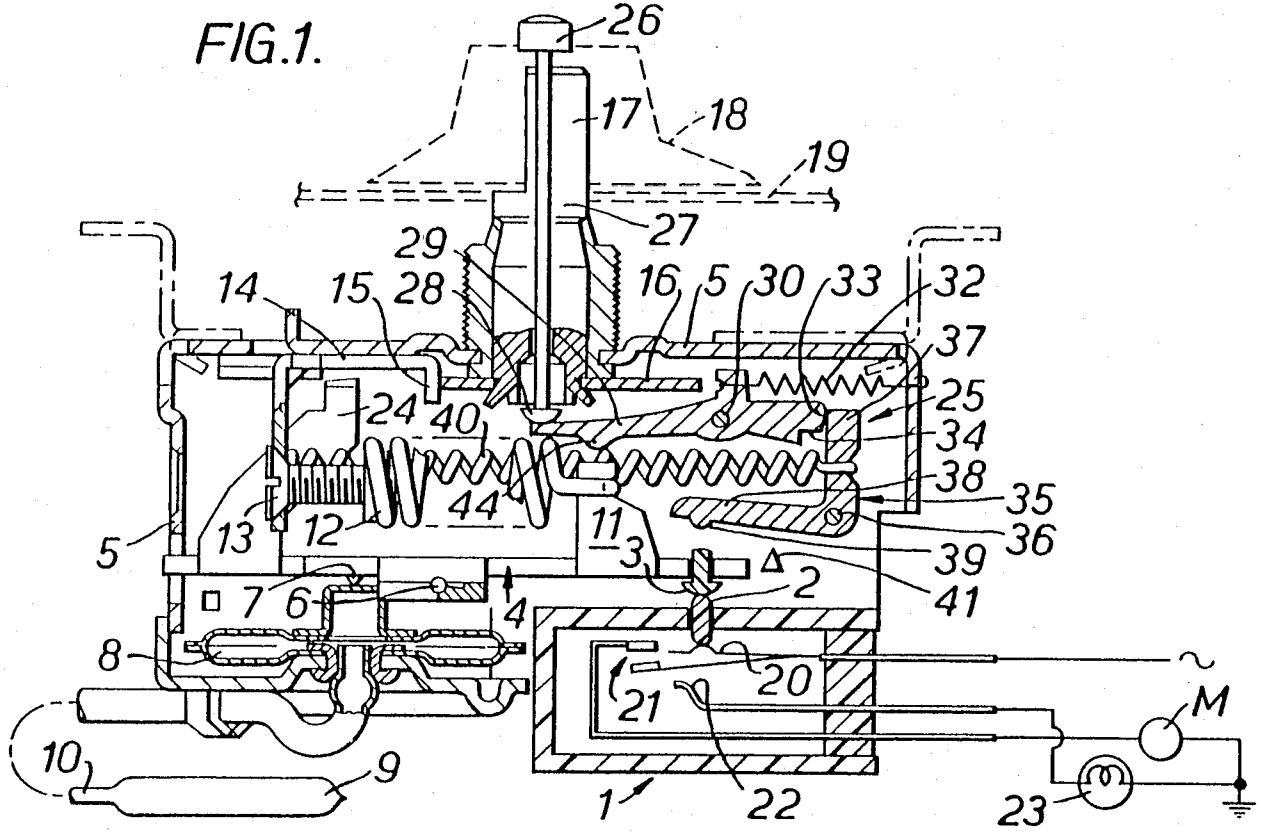
FIG. 1 is a diagrammatic sectional view of a thermostatic switch unit according to one embodiment of the invention for controlling the operation of a freezer, in its condition for normal cycling operation of the thermostatic control.
Figure 2:
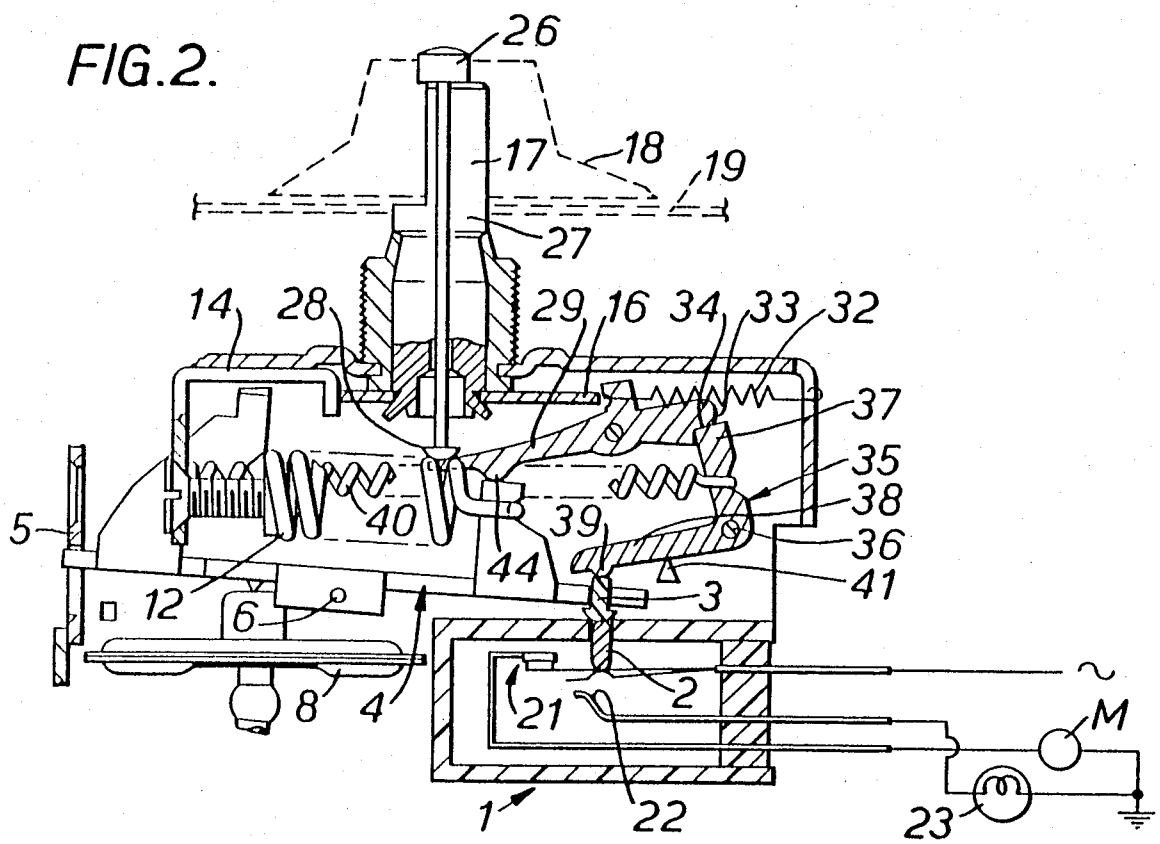
FIG. 2 is a diagrammatic sectional view corresponding to FIG. 1 and illustrating the unit in its manually tripped setting for rapid freezing or temperature "pull-down" operation.
Figure 3:
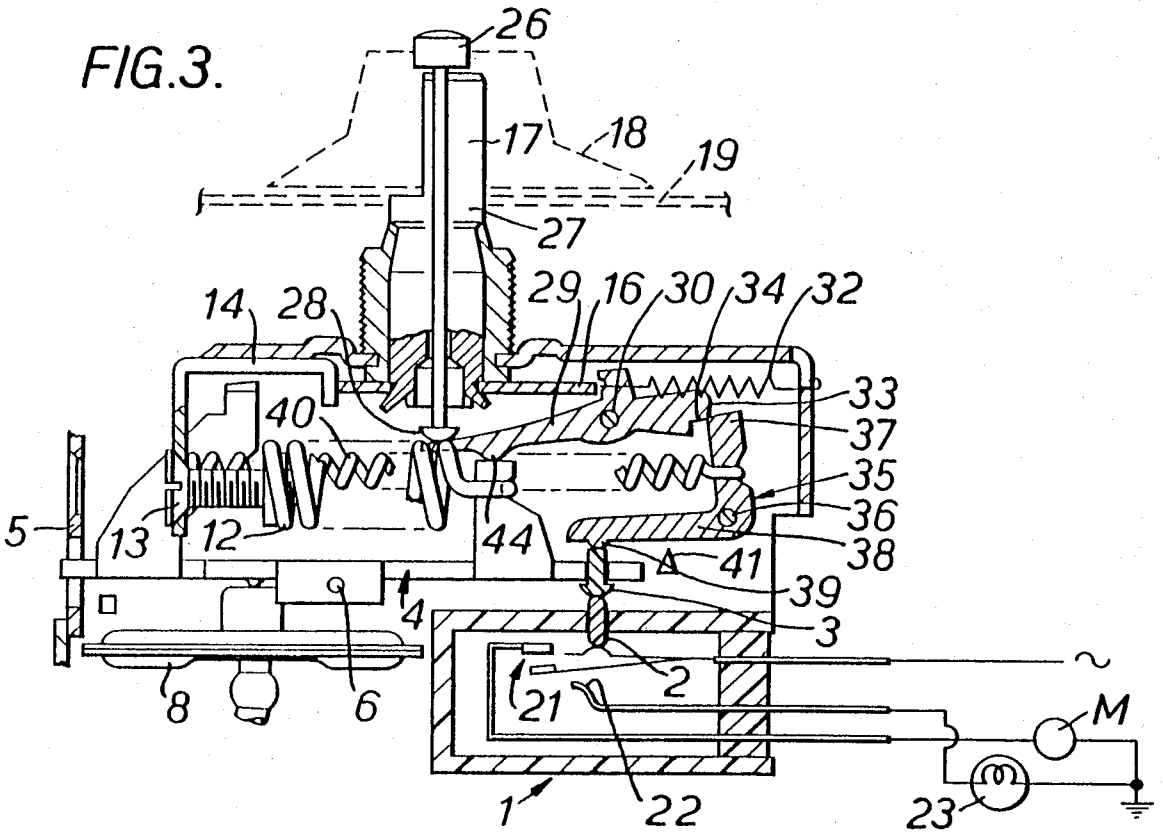
FIG. 3 is a diagrammatic sectional view corresponding to FIG. 1 and illustrating the unit in its tripped position following a temperature "pull-down" operation.

The thermostatic switch unit illustrated in FIGS. 1 to 3 controls the operation of the compressor motor M of a freezer apparatus in response to temperature sensed in the freezer compartment of the apparatus. The switch unit includes a noramlly open snap action switch 1 connected in the power supply to the compressor motor M. The switch 1 has an operating button 2 which is engaged by a short plunger 3 tied at one end of a switch operating lever 4. The operating lever 4 is pivotally mounted on the frame of the switch unit, part of which is shown diagrammatically at 5, the pivot axis 6 of the lever 4 being intermediate the end of the lever.

At its end opposite the plunger 3 the lever 4 has a protuberance 7 which is engaged by a central movable part of a bellows 8. The bellows 8 is hermetically sealed and is in communication with a temperature sensing bulb 9 located in the freezer compartment of the apparatus. The bellows 8 and the bulb 9 are interconnected by a capillary tube 10 forming a sealed system containing a vapour filling.

Between the pivot axis 6 and the plunger 3 the operating lever 4 has an upstanding arm 11 which provides an anchorage for one end of a helical tension spring 12, the other end of which has a screw adjustable anchorage 13 located on a cam slider 14. The cam slider 14 is slidable on the frame 5 of the unit in the general direction of the tension in the spring 12. The tension in the spring 12 acts on the operating lever 4 in a sense to oppose the thrust of the bellows 8.

The cam slider 14 is formed with a cam follower flange 15 which is maintained by the tensioning spring 12 in engagement with a cam surface on a cam disc 16 fixed to the inner end of a control shaft 17 rotatably mounted in the frame 5 of the unit about an axis which is perpendicular to the pivot axis 6 of the lever 4 and perpendicular to the tension in the spring 12. The shaft 17 carries an adjusting knob 18, shown in broken outline, which is rotatable relative to a fixed dial 19 fixed to the outside of the frame 5.

As so far described the switch unit is generally similar to known types of thermostatic control exemplified by U.K. Patent Specification No. 1558474. The bulb 9 located in the freezer compartment senses the operating temperature and controls the operation of the compressor motor M through the thermostat mechanism. When the temperature sensed by the bulb 9 rises to a predetermined "cut-in" temperature expansion of the bellows 8 closes the switch 1 through the action of the lever 4, opposed by the tension spring 12 and cuts-in the compressor motor M. The working temperature of the freezer then falls, until a "cut-out" temperature $T_O$ (FIG. 5) is reached, when the resulting contraction of the bellows 8 allows the spring 12 to move the operating lever 4 so as to open the switch 1. In normal operation of the thermostatic switch unit the compressor motor M will be controlled by the switch 1 in this way so as to operate intermittently, causing the working temperature in the freezer compartment to vary cyclically between upper and lower limits of a normal working range. The mean temperature $T_M$ of the working range can be preset by rotation of the shaft 17 by means of the knob 18, the dial 19 being calibrated accordingly, such rotation effecting displacement of the cam slider 14 and thereby changing the tension in the spring 12 opposed to the action of the bellows 8.

The snap action switch 1 controlled by the thermostat mechanism has, in the illustrated embodiment, an operating tongue 20 which is displaced by the switch operating button 2 to effect snap closure of switch contacts 21. Auxiliary switch contacts 22 mounted within the housing of the switch 1 are closed by movement of the switch operating tongue 20 beyond its normal range of movement for operating the switch contacts 21. The auxiliary contacts 22 are connected in a circuit with a warning lamp 23. The auxiliary contacts 22 are closed, to illuminate the warning lamp 23, when the switch operating button 2 is subjected to an overtravel movement resulting from expansion of the bellows 8 due to a sensed temperature $T_H$ in the freezer compartment higher than the normal operating range of the apparatus. Thus the illumination of the lamp 23 indicates to the user that a dangerously high temperature $T_H$ exists in the freezer compartment, for example as a result of compressor failure.

The switch operating lever 4 is provided with an upstanding appendix 24 which is engageable by a ramp (not shown) on the cam disc 16 in one position of the control shaft 17, to effect direct mechanical rocking movement of the lever 4 in a sense to open the switch contacts 21. This enables the freezer apparatus to be switched off by direct manual operation of the knob 18.

The switch unit is provided with manually operable means for acting on the thermostat mechanism in order to cause the thermostatic switch 1 to close, while at the same time applying a force to the operating lever 4 opposed to the force applied by the spring 12, so as to modify the position at which the switch 1 opens to cut out the motor M. These manually operable means in this embodiment consist of a latch mechanism 25 which can be tripped by a push button 26 mounted on a push rod 27. The push rod 27 is slidable in an axial bore in the shaft 17 and is provided at its inner end with a foot 28 which bears upon one end of a trip lever 29. The trip lever 29 is pivotally mounted on the frame 5 of the unit about an axis 30 and is preloaded by a biassing spring 32 which exerts a clockwise turning moment, exerting a force against the push rod 27. The other end of the trip lever 29 is formed with a cam surface 33 and, adjacent the cam surface 33, with a notch 34 facing in the general direction of the switch 1. A bellcrank lever 35 is pivotally mounted in the frame 5 about an axis 36 and has an upstanding arm 37 which, in the normal cycling position of the unit, illustrated in FIG. 1, bears against the cam surface 33. The bellcrank lever 35 also has an operating arm 38 which projects generally parallel to the trip lever 30 and which is formed with a heel 39. In the normal cycling position of the mechanism, illustrated in FIG. 1, the heel 39 is spaced from the operating plunger 3 of the switch 1.

The bellcrank lever 35 is preloaded by a helical tension spring 40, extending generally parallel to the spring 12, anchored at one end to the arm 37 of the bellcrank lever 35 and at its other end to a suitable adjustable anchorage (not shown) on the cam slider 14, similar to that provided for the spring 12. In the normal cycling position of the thermostat unit (FIG. 1) the spring 40 maintains the bellcrank lever 35 in its latched position, in engagement with the cam surface 33, in which the heel 39 of the lever is clear of the switch operating plunger 3. Under these conditions the operation of the switch 2 is controlled by the temperature sensing bellows 8 in the normal way the upper and lower limits $T_I$ and $T_O$ of the normal working range of the unit being preset by the tension in the biassing spring 12, which in turn is determined by the setting of the cam shaft 17. Presetting of the tension in the spring 12 can also be effected by adjusting the screw anchorage 13 of the spring 12. In normal operation of the thermostat, therefore, the compressor motor M is controlled by the switch 1 so as to cause the temperature in the freezer compartment to vary cyclically between the predetermined cut-in and cut-out temperatures $T_I$, $T_O$.

When it is desired to effect a rapid freezing operating by a period of continuous operation of the compressor motor 1 the push button 26 is depressed. This causes rocking of the trip lever 30, during which the arm 37 of the bellcrank lever 35 slides along the cam surface 33 until it engages in the notch 34. The bellcrank lever 35 is then pulled into a "fast freeze" position (FIG. 2) with the arm 37 held in engagement in the notch 34 by the spring 40. In this position the arm 38 of the bellcrank lever 35 engages a fixed top 41 and the heel 39 engages the switch operating plunger 3, closing the switch contacts 21. The stop 41 is so positioned that the depression of the switch operating button 2 is limited, falling short of the displacement necessary to close the auxiliary contacts 22. The warning lamp 23 therefore remains unlit and does not give a false indication of excessive temperature. It is, however, still possible for the operating lever 4 to close the auxiliary switch contacts 22 in the event of an excessively high temperature being reached, for example as a result of compressor failure.

By acting on the plunger 3 attached to the end of the switch operating lever 4 the spring loaded lever arm 38 applies a force to the operating lever 4 which opposes the force applied by the biassing spring 12. This in effect means that, in order to re-open the switch contacts 21, the bellows 8 must decrease its thrust to a greater extent than is necessary when the spring 12 acts solely on the lever 4. In other words, the switch contacts 21 re-open when a predetermined low temperature $T_L$, lower than the cut-out temperature $T_O$, is sensed in the freezer compartment. Consequently, the compressor motor M runs continuously until the temperature in the freezer compartment has been pulled down to the low temperature $T_L$, the value of which is determined by adjusting the load applied by biassing spring 40 to the lever 35.

Once the predetermined low temperature $T_L$ has been reached in the freezer compartment the bellows 8 contracts sufficiently to allow the operating lever 4, under the action of the tension spring 12, to move against the spring loaded lever arm 38 and re-open the switch contacts 21. At the same time, the bellcrank lever 35 is rocked, in a clockwise direction, until its arm 37 is disengaged from the notch 34 and rests against the adjacent end of the cam surface 33 (FIG. 3). Once this happens, the resilient loading of the trip lever 30 by the spring 32 causes the cam surface 33 to ride over the end of the lever arm 37, causing a further clockwise rocking movement of the bellcrank lever 35 until the rest position, illustrated in FIG. 1, is reached. When returned to its reset position the trip lever 30 acts on the push rod 27, returning the push button 26 to its initial position. The unit is then set to return to normal cycling operation, as described above, without further manual intervention being necessary.

It will be seen that the illustrated thermostatic switch unit is capable of effecting a single cycle during which the temperature in the freezer compartment is pulled down rapidly to a predetermined low temperature $T_L$, after which the unit reverts automatically to its normal cycling operation. Fast freezing of food introduced into the freezer compartment can therefore be effected simply by pressing the push button 26, irrespective of the temperature setting of the control knob 18. After a single temperature pull-down or fast-freeze cycle the thermostatic switch unit will be reset automatically to its normal cycling between the temperatures $T_I$ and $T_O$ predetermined by the setting of the knob 18.

Figure 5:
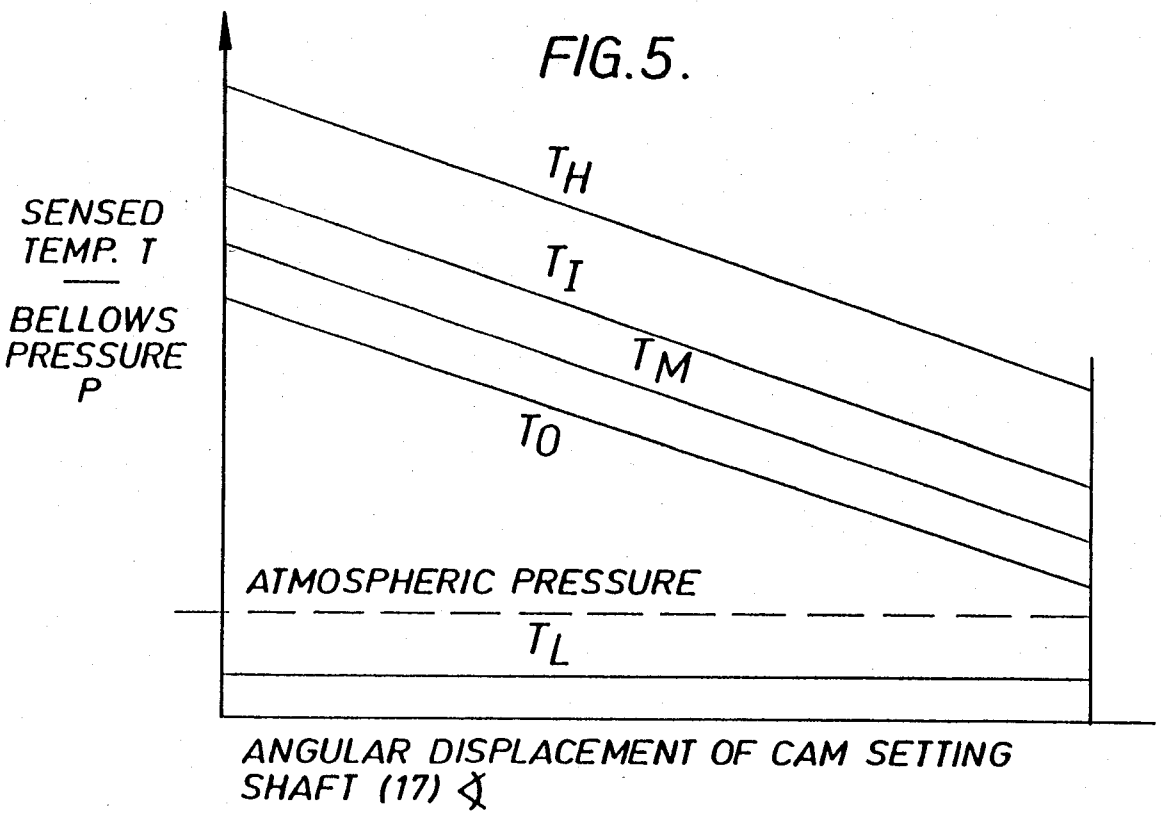
FIG. 5 is a graphical illustration of the relationship between the internal pressure of the vapour-filled bellows of the thermostatic switch unit of FIGS. 1 to 3 and the angular displacement of the thermostat setting shaft.

The fact that the biassing springs 40 has one end anchored to the cam slider 14 provides a "pull-down" temperature $T_L$ which is substantially constant, irrespective the angular portion of the cam setting shaft 17 and, therefore, of the knob 18 (FIG. 5). This can be achieved by selecting a spring rate value of the spring 40 such that different tensions in the spring 12 for different angular settings of the came shaft 17 are offset by equivalent loadings of the spring 40.

In an alternative embodiment of the invention (not illustrated) the spring 40 may be anchored to a fixed anchorage on the frame 5 of the unit. Should this be the case the temperature $T_L$ would be variable by acting on the setting knob 18, and will have a substantially fixed differential with respect the temperature $T_O$.

Figure 4:
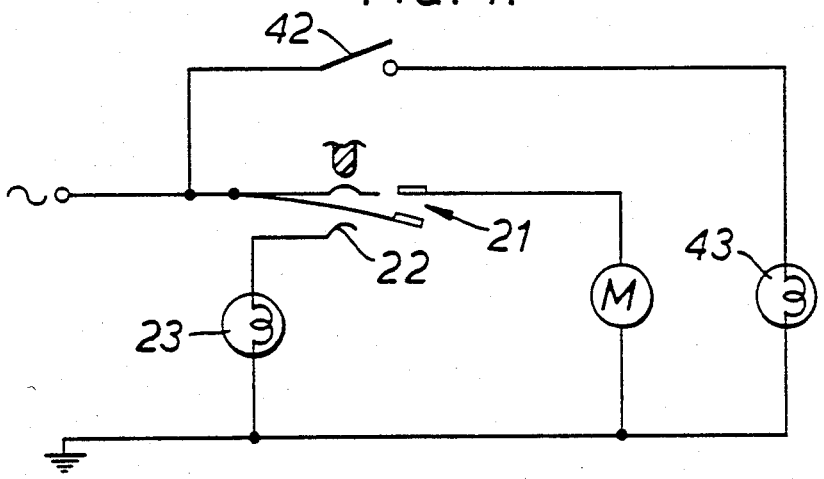
FIG. 4 is an electrical circuit diagram of a switch unit such as that shown in FIGS. 1 to 3.

FIG. 4 illustrates a circuit diagram which may be associated with a switch unit of the kind illustrated in FIGS. 1 to 3. In addition to the switch contacts 21 and 22 a further pair of normally open switch contacts 42 may be provided. These switch contacts 42 may be operatively associated with the bellcrank lever 35, or with some other part of the latch mechanism 25, to be closed when the latch mechanism is in the tripped or fast freeze position (FIG. 2) completing the circuit for an indicator lamp 43. This lamp would have a different colour from the warning lamp 23 and its illumination would indicate to the user that the unit was performing a fast-freeze or temperature "pull-down" operation.

The vapour filling of the bellows 8 is such that the vapour pressure in the bellows is less than the prevailing atmospheric pressure T (FIG. 5), at the "pull-down" temperature $T_L$. This ensures that, in the event of a fluid leakage in the bellows or its associated capillary 10 or bulb 9, the pressure in the bellows 8 will always be sufficient to maintain the switch contacts 21 closed once the push-button 26 is depressed, to effect continuous running of the compressor motor M. This will ensure that food in the freezer compartment remains frozen until appropriate service attention can be given to the freezer.

In an alternative embodiment of the invention the lever 29 may be provided with an appendix 44 which abuts the arm 11 of the switch operating lever 4 when the button 26 is manually depressed. The appendix 44 in the last portion of its travel will operate the switch lever 4 so as to close the auxiliary switch contacts 22 and energise the lamp 23.

When the button 26 is released the trip lever 29 will rest on the bellcrank lever arm 37 as shown in FIG. 2. In this position the appendix 44 no longer abuts the switch lever arm 11. This arrangement of energizing the warning lamp 23 when the button 26 is fully depressed has the advantage of indicating visually for a short while the initiation of a temperature pull-down cycle, informing the user that the manual operation has been completed.

If the button 26 is operated in error it is possible to cancel the temperature "pull-down" operation by rotating the setting knob 18 to OFF: As described previously the switch operating lever 4 has an appendix 24 engageable by a ramp of the cam disc 16 to effect a mechanical opening of the switch contacts 21. This action will also reset the latch mechanism 25, allowing the usual cycling mode of the thermostat unit to be resumed.

We claim:

1. A thermostat unit for a refrigeration or freezer apparatus comprising:

(a) a switch for controlling the operation of the apparatus, said switch having an open condition and a closed condition wherein the apparatus is operated;

(b) a single temperature sensing element for producing actuating forces in response to sensed temperature in the apparatus;

(c) a thermostat mechanism reacting between said sensing element and said switch, said thermostat mechanism comprising:

(i) a switch operating lever for transmitting force between said sensing element and said switch;

(ii) a first spring acting in opposition to said sensing element; and (iii) adjustment means for adjusting the force of said first spring to adjust the normal working temperature of the apparatus between upper and lower limits; and (d) rapid refrigeration means for closing said switch to cause continuous operation of said apparatus until said sensing element senses an apparatus temperature below said lower limit of said normal working temperature, said rapid refrigeration means comprising:

(i) a latch mechanism;

(ii) a pre-loaded element which is normally retained by the latch mechanism in an inoperative position, said pre-loaded element movable to an operative position of engagement with said thermostat mechanism;

(iii) a second spring acting upon the pre-loaded element and effective, when said pre-loaded element is in said operative position, to oppose said first spring for effecting closure of said switch at sensed temperatures within said normal working temperature range; and (iv) a push-button connected to the latch mechanism to trip the latter upon manual operation of the push-button to release the pre-loaded element into the operative position;

(e) said thermostat mechanism effective, in response to a sensed temperature below said normal working temperature lower limit, to return said pre-loaded element to said inoperative position, relatching said pre-loaded element and said latch mechanism and returning said switch to said open condition.

2. A thermostatic switch unit as defined in claim 1, wherein the pre-loaded element comprises a second lever which is normally retained by the latch mechanism clear of the thermostat mechanism, tripping of the latch mechanism causing the second lever to load the thermostat mechanism.

3. A thermostatic switch unit as defined in claim 1 or 2, wherein the latch mechanism includes a trip lever which has a reset position in which it engages the pre-loaded element and maintains it in its inoperative position and a tripped position in which it releases the pre-loaded element into its operative position, and resilient means biasing the trip lever into its reset position.

4. A thermostatic switch unit as defined in claim 3, wherein the trip lever has a cam surface which is engaged by the pre-loaded element when the latter is in its inoperative position, such that, when the sensed temperature reaches the said predetermined pull-down value after tripping of the latch mechanism, the pre-loaded element is displaced by the thermostat mechanism to a position in which it re-engages the said cam surface and is retained in engagement therewith by the resilient means biasing the trip lever.

5. A thermostatic switch unit as defined in claim 4, wherein the trip lever is displaced into its reset position under the action of said resilient means when the pre-loaded element re-engages the cam surface, and causes, through said cam surface, a displacement of the pre-loaded element into its inoperative position.

6. A thermostatic switch unit as defined in claim 3, wherein the adjustment means for adjusting the force of the first spring include a shaft having a bore and a setting cam mounted on said shaft, and wherein the trip lever is movable into its tripped position by manual operation of the push-button, which is movable axially in said bore of the shaft.

7. A thermostatic switch unit as defined in claim 1 or claim 2, wherein the predetermined pull-down temperature at which the switch is re-opened is substantially independent of the working temperature range setting of the thermostat mechanism.

8. A thermostatic switch unit as defined in claim 1, wherein the means for adjusting the force of the first spring also acts on the second spring.

9. A thermostatic switch unit as defined in claim 1, in which the temperature sensing element comprises a vapour-filled bellows or the like element which is responsive to the working temperature of the controlled apparatus and which operates the associated switch, the vapour pressure in the bellows being less than the atmospheric pressure at the achievement of the predetermined pull-down temperature at which the latch mechanism is reset.

10. A thermostatic switch unit as defined in claim 1, wherein the switch has a movable contact and associated auxiliary contacts for connection to a warning device, whereby an overtravel displacement of the movable switch contact in response to a sensed temperature above the normal working range of temperatures of the apparatus causes closure of the associated auxiliary switch contacts to operate said warning device, irrespective of whether or not a temperature pull-down operation is in progress.

11. A thermostatic switch unit as defined in claim 1 or claim 8, in which the predetermined temperature at which the switch is re-opened is variable upon variation of the working temperature setting of the thermostat mechanism.

12. A thermostatic switch unit as defined in claim 1 or 2 and further including a plunger carrier by the thermostat mechanism and acting directly on the switch, said plunger being engageable by said latch mechanism whereby when the pre-loaded element is tripped into its operative position the plunger effects closure of the switch, the automatic resetting of the latch mechanism being effected by the thermostat mechanism acting directly upon the pre-loaded element, and the switch operating plunger allowing the switch to reopen only upon resetting of the latch mechanism.

13. A thermostatic switch unit as defined in claim 1 or claim 2, including signal means affording a visual temporary indication upon each operation of the push-button to initiate a temperature "pull-down" cycle.

14. A thermostatic switch unit is defined in claim 1 or claim 2, wherein the adjustment means for adjusting the force of the first spring iclude a cam and a cam shaft on which the cam is mounted, the cam cooperating with the latch mechanism whereby resetting thereof is effected by angular movement of the cam shaft to a particular angular setting.

* * * * *